US005599204A

United States Patent [19]

Glassford

[11] Patent Number: 5,599,204

[45] Date of Patent: Feb. 4, 1997

[54] VOLTAGE ADAPTER

[76] Inventor: Joseph B. Glassford, 620 N. Arbogast St., Griffith, Ind. 46319

[21] Appl. No.: 432,027

[22] Filed: May 1, 1995

[51] Int. Cl.[6] ..... H01R 11/00

[52] U.S. Cl. ..... 439/502; 439/638

[58] Field of Search ..... 439/502, 504, 439/638, 639, 623, 624; 320/2

[56] References Cited

U.S. PATENT DOCUMENTS

| | | | |
|---|---|---|---|
| 2,675,444 | 4/1954 | Shapiro . | |
| 3,137,448 | 6/1964 | Holzhause . | |
| 3,259,754 | 7/1966 | Matheson | 439/504 X |
| 3,896,364 | 7/1975 | Reister | 320/2 OR |
| 4,054,352 | 10/1977 | Rudin . | |
| 4,261,634 | 4/1981 | Robinson . | |
| 4,267,430 | 5/1981 | Downey . | |
| 4,310,874 | 1/1982 | Spiteri . | |
| 4,319,798 | 3/1982 | Mittelhäuser . | |
| 4,647,139 | 3/1987 | Yang . | |
| 4,789,361 | 12/1988 | Kinzalow et al. . | |
| 4,936,796 | 6/1990 | Anderson, Jr. . | |
| 4,999,752 | 3/1991 | Rogers et al. . | |
| 5,007,863 | 4/1991 | Xuan . | |

*Primary Examiner*—Gary F. Paumen
*Assistant Examiner*—Daniel Wittels
*Attorney, Agent, or Firm*—Olson & Hierl, Ltd.

[57] ABSTRACT

An adapter is provided for supplying electric power of 12 volts to a male plug associated with conventional 120 volt electrical wiring. In the adapter, a male plug adapted for functional engagement with a conventional vehicular cigarette lighter is connected through a relatively short length of insulated two-wire cord to a standardized type of three-socket female. electrical plug such as is associated with conventional 120 volt electrical wiring. Power of 12 volts can thus be delivered to this female plug so that a standardized male plug connected thereto can deliver such power into associated wiring. Optionally, the adapter can also include battery connector clips for direct connection with a 12 volt vehicular battery, if desired.

8 Claims, 1 Drawing Sheet

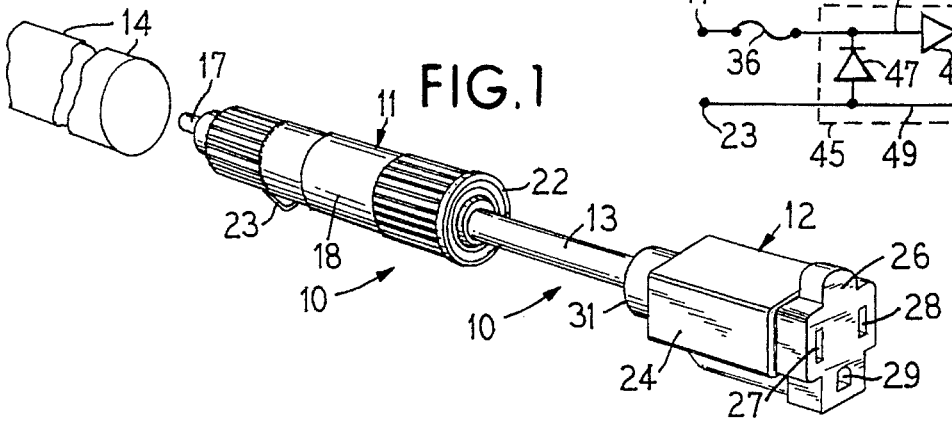
FIG. 1
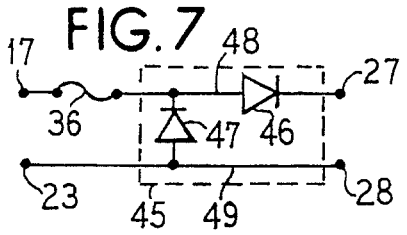
FIG. 7
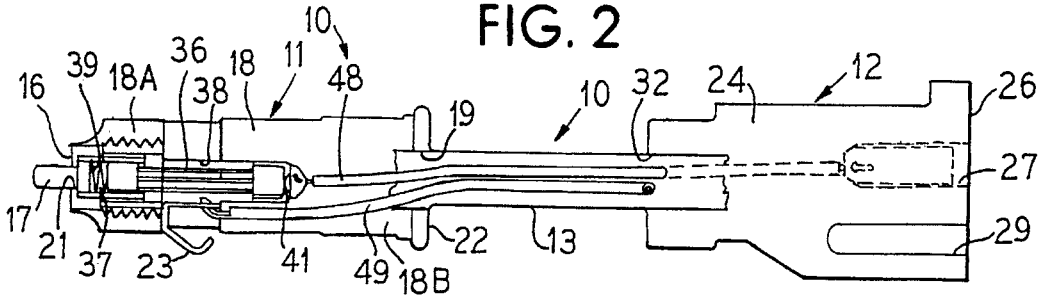
FIG. 2
FIG. 3
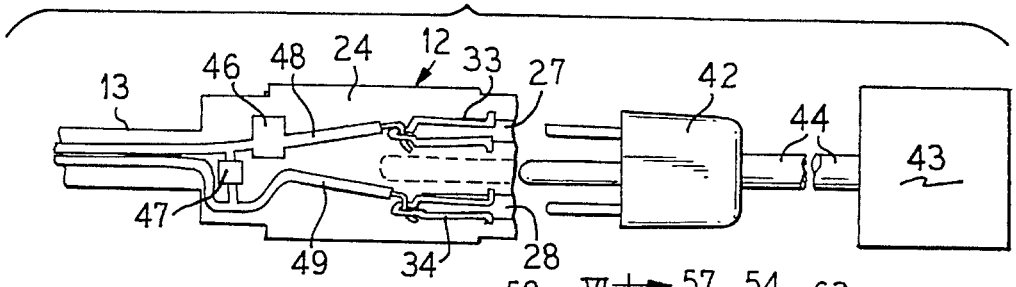
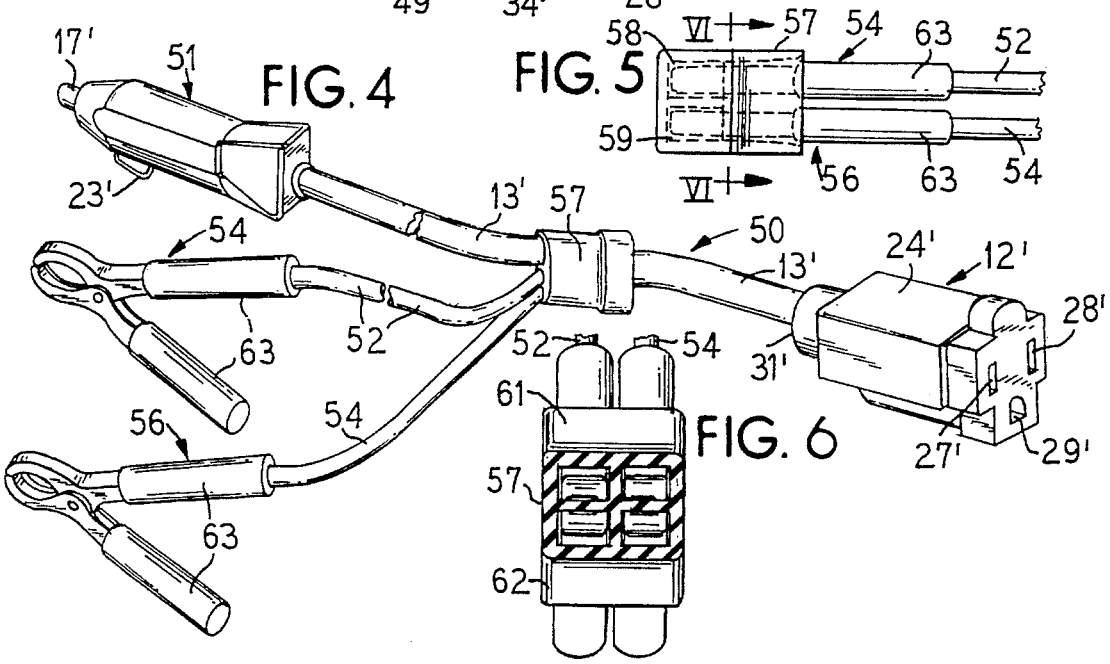
FIG. 4
FIG. 5
FIG. 6

VOLTAGE ADAPTER

FIELD OF THE INVENTION

This invention lies in the field of adapters for interconnecting a low voltage current source with a standard male plug associatable with conventional wiring of the type normally used for substantially higher voltage currents.

BACKGROUND OF THE INVENTION

Homeowners, mechanics, campers, recreational vehicle operators, motorists, farmers, emergency personnel and the like need a simple and dependable means for connecting vehicular 12 volt electrical power to wiring adapted for use with standard voltage (120 volts). The problem is that no simple and dependable compatible connection means exists for interconnecting such differing voltages with standardized plugs of the types employed for conventional line voltages.

So far as now known, a simple and dependable adapter for making this connection has not previously been known although there has been a long felt need in the art for such a structure. The present invention provides such an adapter and fulfills such long felt need.

SUMMARY OF THE INVENTION

More particularly, this invention relates to an adapter for interconnecting a vehicular source of 12 volts direct current or the like with a male plug of the type associated with conventional 120 volt AC current wiring or the like.

The inventive adapter incorporates a male plug adapted to be slidably engagable with, and disconnectable from, the socket of a conventional vehicular cigarette lighter. When so engaged, the plug is adapted to conduct a 12 volt current from the socket.

The inventive adapter further incorporates a standardized three socketed female electrical plug of the type normally associated with conventional 120 volt AC wiring.

In the inventive adapter, the standardized female plug is electrically interconnected with the cigarette lighter male plug through a relatively short length of insulated two-wire electrical cord or the like.

The adapter preferably incorporates a fuse which limits the current amperage which can flow through the adapter to a predetermined maximum value.

Preferably, the three socketed female electrical plug is adapted for interconnection with any standardized two or three pronged male type electrical connector.

Optionally, the inventive adapter further incorporates a pair of battery connector clips each of which is independently connected to the inventive adapter through lead wire means so that the inventive adapter can also be directly connected to the respective positive and negative terminals of a 12 volt vehicular storage battery or the like if desired for purposes of energizing the female plug with a 12 volt power supply. Optionally, but preferably, an insulative storage pouch is provided so that, when such pair of battery connector clips is not in use, the pouch can cover or enclose exposed electrically conductive portions thereof for operator safety reasons.

As constructed, the adapter is able to supply a current of 12 volts to the three socketed female electrical plug so that a two or three pronged male electrical plug that is connected with the three socketed female electrical plug can be supplied with a current of 12 volts. Thus, when, for example, the two or three pronged male electrical plug is itself connected with an electrical cord, and this cord is connected with, for example, a conventional light bulb socket, and a 12 volt light bulb is connected with this socket (in place of, for example, a 120 volt light bulb), a source of light is obtained which can be remote relative to the source of the 12 volt current.

The inventive adapter thus makes possible, in a simple, effective and reliable manner, the conversion of any household, shop or utility conventional light socket that is adapted to operate on the standard voltage of 120 volts AC to a light socket that is adapted to operate on the standard voltage of 12 volts such as is available from an operating vehicle or from a 12 volt DC vehicular or similar battery.

The adapter permits one to use a residential extension cord to provide 12 volt electrical power for a home during a power failure of normal house power of 120 volts. The 12 volt power supply can be variously and alternatively used; for example, such power supply can be used to operate a 12 volt sump pump or other piece of electromechanical apparatus.

The inventive adapter is very useful for emergency situations and in camping expeditions, in association with recreational vehicles of all types, in the field mechanics (as when changing a flat tire at night, etc.), and in similar applications. Indeed, every vehicle operator should probably incorporate the adapter into his vehicle's on-board emergency equipment.

The adapter is simple, reliable, inexpensive and rugged.

Preferably, in the inventive adapter, the interconnecting cord is sealed to the female plug to enhance durability and to resist electrical shorting (for example, from the accidental spillage of a beverage or the like).

The presence of a fuse in the adapter enhances safety. For example, a fuse can prevent an inadvertent attempt to deliver a current at 120 volts through the adapter.

Other and further objects, aims, features, advantages, embodiments, applications and the like will be apparent to those skilled in the art from the present specification, accompanying drawings and appended claims.

BRIEF DESCRIPTION OF DRAWINGS

In the drawings;

FIG. 1 is a perspective view of one embodiment of the voltage adapter of this invention;

FIG. 2 is a diametrical longitudinal sectional view taken through the FIG. 1 embodiment which incorporates a conventional male plug and a conventional female socket;

FIG. 3 is a fragmentary view similar to FIG. 2, but showing the conventional three socket female electrical socket rotated 90°, showing the manner in which this socket associates with a conventional three prong male electrical plug and also showing the manner in which the female socket can incorporate voltage limiting mean;

FIG. 4 is a perspective view of an alternative embodiment of the voltage adapter of this invention;

FIG. 5 is a fragmentary plan view showing both the battery connector clips of the FIG. 4 embodiment in association with an insulating connector sheath;

FIG. 6 is a transverse enlarged sectional view taken along the line VI—VI in FIG. 5; and FIG. 7 is a simplified schematic diagram of the voltage limiting, current limiting circuitry employed in a preferred embodiment of the FIG. 1 and FIG. 2 adapter.

DETAILED DESCRIPTION

Referring to FIGS. 1–3, there is seen one embodiment 10 of an adapter of the present invention which incorporates a known type of male electrical connecting plug 11, a female type electrical connecting socket 12, and a relatively short length of interconnecting insulated two-wire electrical cord 13.

The plug 11 is adapted for slidable engagement with, and disengagement from, the standardized cylindrical socket 14 of a conventional vehicular cigarette lighter. The plug 11 can have many different structures, but preferably it has a cylindrical profile in the regions thereof that engage the socket 14. Plug 11 here preferably has an electrically insulative body 18 comprised of rigid molded plastic components or the like. Body 18 has a cord aperture 19 at the rear end 22 thereof and a post aperture 21 at the forward end 16 thereof. Plug 11 has at the forward end 16 a forwardly projecting, electrically conductive post 17 that is supported by body 18 and post aperture 21. Post 17 is adapted for making electrical contact with a conventional positively electrically charged contact (not shown) that is conventionally associated with, and electrically insulated from, the interior end of the socket 14. The socket 14 itself is usually comprised of formed sheet metal. Post 17 can be formed of molded steel or the like. Plug 11 also has a laterally outwardly extending, and preferably laterally outwardly biased, electrically conductive leg means 23 for making electrical connection with an electrically negative conductive inside surface portion of the socket 14. Conveniently, leg means 23 is comprised of a U-configured strip of resilient sheet steel or the like and is associated with body 18. Male plug 11 is thus adapted for receipt and transmission of vehicular electrical power being fed to a cigarette lighter, which is typically 12 volts direct current.

The socket 12 preferably has an electrically insulative housing 24 that is comprised preferably of somewhat elastomeric molded plastic or the like. Housing 24 has a forwardly facing terminal flat face 26 defined thereon. Face 26 has three contiguous socket channels 27, 28 and 29 defined therein. Two of these socket channels 27 and 28 have opposed flattened side walls and so are rectangular in cross sectional configuration. The third socket channel 29 has a rounded side wall portion along its length. The socket channels 27, 28 and 29 are positioned and formed so that in combination they are adapted to be connectable with any conventional, standardized two prong or three prong male type electrical connector for a power source of predetermined voltage, such as (preferably) 120 volts. For such universal connectability purposes, one rectangular socket channel 27 is somewhat longer in its cross sectional length than the cross sectional length of the other rectangular socket channel 28 so as to permit the socket 12 to be connectable with all conventional plugs wherein one rectangular prong is larger and both rectangular plugs are wired for conventional polarized power transmission purposes.

In the case of a three prong polarized plug, the larger rectangular socket channel 27, as shown, is located in clockwise orientation to the other socket channel 28 and channel 29. Such an electrical connector 12 thus can be any one of (a) a conventional 3-prong male electrical plug of the type employed in conventional 120 volt wiring; (b) a conventional 2-prong male electrical plug of the type employed in conventional 120 volt wiring; and (c) a conventional 3-prong male electrical plug of the so-called polarized type employed in conventional 120 volt wiring wherein one of the two flat prongs is somewhat larger than the other flat prong.

The housing 24 also has a second and preferably rearwardly facing forward end face 31 wherein a cord aperture 32 is defined.

In socket 12, each of the socket channels 27 and 28 is independently associated on respective interior wall portions thereof with a different electrical contact means such as, for example, strip 33 and strip 34, respectively, which are each conveniently comprised of copper or other electrically conductive formed material or metal. Strips 33 and 34 are each preferably molded in place during formation of socket 12, or the like. No electrical contact means is associated with socket 29.

The two-wire electrical cord 13 extends between and projects into each of the respective cord apertures 19 (in plug 11) and 32 (in socket 12). Of the two wires in cord 13,.one wire 48 is interconnected between one contact strip, such as strip 33, and conductive post 17, while the second wire 49 is interconnected between the second contact strip, such as strip 34, and conductive leg 23.

Preferably a fuse means for limiting the maximum amperage of current which can pass between plug 11 and the socket 12 is incorporated into adapter 10 by being connected in parallel with one of the two wires 48 and 49. For example, the fuse employed can be a replaceable conventional fuse 36 of the well-known type that is housed in a glass cylinder with opposed electrically conductive metallic sealing cylinder end caps, or the like. Such a fuse 36 can, if desired, and for example, have a rating of about 5 amperes or the like. Such a fuse 36 can be incorporated into the body 18 of plug 11. For example, one end of fuse 36 can be seated in a pocket 37 defined in the interior end portion of post 17. The opposite end portion of fuse 36 can abut against a contact 41 to which one end of the wire 48 is connected in body 18. The body of fuse 36 extends with an axial channel 38 that is defined in body 18 and that has at its inner end the contact 41. For purposes of accommodating fuse 36 in body 18, and for purposes of convenient replacement of a fuse 36 in body 18, the body 18 is here comprised of two longitudinally interconnecting portions 18A and 18B. Portion 18A serves as an end cap and is internally threaded for engagement with a mating externally threaded forwardly projecting nose portion that is integral with portion 18B and that serves as a main part of body 18. A coiled spring 39 in pocket 37 exerts a biasing pressure on one end of fuse 36 to assure good electrical connection between fuse 36 opposite ends and the respective electrical contacts provided by post 17 and contact 41. Alternative arrangements can be employed if desired.

Thus, adapter 10, when plug 11 is interconnected with a cigarette lighter socket 14, and when socket 12 is interconnected with, for example, the three prong plug 42 of an electrical device 43 that is fitted with a connected power supply cord 44 between plug 42 and device 43, can pass low voltage (for example, 12 volts) current charged through the electrified cigarette lighter socket 14 into plug 11, through cord 13 and then through socket 12 into plug 42, thereby energizing the device 43. Device 43 can be, for example, a 12 volt light bulb, a 12-volt sump pump, or the like, such as might be used for emergency situations, camping, recreational vehicles, and the like.

For use in a lighting application, for example, one procedure would be to insert a 12-volt DC light into a conventional light bulb fixture which is to be employed and which is associated with a conventional 120 volt extension cord or the like. The plug of the extension cord is plugged into socket 12 and plug 11 is plugged into any vehicular cigarette lighter socket 14. As those skilled in the art will readily appreciate, the adapter 10 is not suitable for use with so-called "touch lamp" halogen lights or with fluorescent fixtures. However, the adapter 10 is suitable for powering various sizes of 12 volt light bulbs. For example, a 25 watt 12 volt bulb gives approximately the same light as a 60 watt 120 volt bulb.

Referring to FIGS. 4–6, there is seen another embodiment 50 of an adapter of the present invention which employs some components which are similar to components employed in the adapter 10. Accordingly, corresponding similar components are similarly numbered, but with the addition of prime marks for distinction purposes. In adapter 50, plug 11 is replaced by the plug 51 which is here illustratively of the known type comprised of two molded halves (not detailed) that longitudinally interengage and are retained together by a set screw or the like (not detailed, but conventional).

In adapter 50, the cord 13' is longer than in adapter 10 At a mid-region of cord 13', each wire (not detailed) thereof is independently connected to a different one of the lead wires 52 and 54 that are terminally connected with respective different ones of a pair of battery connector clips 54 and 56 (conventional). Thereafter, the mid-region splice area along cord 13' can be protectively jacketed with a protective means, such as a heat shrinkable plastic sleeve 57 or the like.

So as to provide a protective fuse means for each of the plug 51 as well as the battery connector clips 54 and 56, a fuse, such as fuse 36, can be connected across one of the two wires in the cord 13'. That fuse can be housed in either the sleeve 57 (so as to be between the splice area and the plug 12') or in the plug 12' (not detailed). Alternatively, the fuse 36 can remain located in the plug 51 (connected in the manner above-described in reference to plug 11) and a second such fuse 36 can so connected (as indicated) across one of the two wires in cord 13' in either the sleeve 57 or in the plug 12' (not detailed). Alternatively, a fuse 36 can be connected across each of the lead wires 54 and 56 and located in each one of the clamp insulator sleeves 54 and 56 (not shown).

For safety reasons, and particularly in order to avoid contact between the battery connector clips 54 and 56 during a time when 12 volt voltage is being drawn through plug 11' (and when the connector clips 54 and 56 are not then in use but are electrified), an electrically insulative storage pouch member 57 is provided (see FIGS. 5 and 6). Pouch 57 is preferably formed of a resilient, somewhat elastomeric molded plastic such as a polyolefin or the like. Pouch 57 is provided with a pair of spaced parallel pockets 58 and 59 into each one of which a different one of the battery connector clips 54 and 56 is received. Longitudinally opposed side edge portions 61 and 62 of pouch 57 are outwardly flared so as to extend along the lower end regions of each of the insulator sleeves 63 (one sleeve 63 pair for each clip 56 and 57). Thus, all electrically conductive exposed portions of each battery connector clip 54 and 56 are nestably receivable within the electrically insulative pouch 57 and so are protected against contact with each other and with an operator.

If desired, the plug 12 and 12' can be replaced by a different female plug which is adapted for connection with a male plug that satisfies a different standard prong arrangement, such as for 240 volts or the like. Various standard prong arrangements are used through the world, as those skilled in the art appreciate but can be associated with an adapter of this invention through the use of an appropriate female plug in place of the plug 12 or 12' (which is used for present illustration purposes). Thus, the sockets of plug 12 or 12' are adapted in combination to be connectable with any predetermined standard two or three prong male electrical connector for a predetermined higher voltage so that 12 volts DC current or the like can be conveyed from a plug 11 or 51 through cord 13 or 13' and delivered to a selected pair of prongs of a selected male plug that is plugged into such socket.

In an alternative mode of practicing the present invention, in adapter 10 the plug 12 additionally incorporates therein voltage limiting device means that either limits passage of a higher voltage current (such as 120 volts) to flow in one current direction only through cord 13, or that prevents current flow in cord 13 at a voltage level that is higher than some predetermined (or set) voltage level, such as a level higher than 12 volts. Such device means overcomes an inherent limitation in the fuse 36 which is that fuse 36 is in effect only a current flow limiting device not voltage; however, owing to a rapid potential rise in current flow through fuse 36 should higher voltage be accidentally somehow fed back through cord 13, fuse 36 rapidly ruptures and so is adequate for many practical purposes. With the aim of achieving fail safe operation for an adapter 10, a voltage limiting device means can be incorporated thereto, if desired.

Referring to FIGS. 3 and 7, there is seen one embodiment of voltage limiting means 45 which can be incorporated into adapter 10, if desired. Incorporated into socket 12 are two diodes 46 and 47. Diode 46 is connected into line 48. Diode 47 is connected across line 48 and 49. Fuse 36 is preferably of the so-called "fast blow" type. Under normal usage conditions, 12 volt DC current passes through line 48 (with fuse 36 and diode 46 being in series) and through low resistance line 49 (from post 17 and leg 23). If under abnormal usage 120 volt current passes through lines 48 and 49 from socket channels 27 and 28 (and sheet metal strips 33 and 34 respectively), current is shunted through diode 47 and fuse 36 ruptures promptly. Load limiting and directing resistors can be used if desired as those skilled in the art will appreciate, but, for reasons of simplicity, are not shown.

While the foregoing description makes use of various illustrative embodiments, no limitations upon the present invention are to be implied or inferred therefrom.

What is claimed is:

1. An adapter for delivering a current of relatively low voltage from a vehicle to a male plug associated with standardized wiring that is adapted for conveying a current of substantially higher voltage, said adapter comprising in combination:

a male type electrical connecting plug for slidable engagement within the socket of a vehicular cigarette lighter, said male plug having:

an electrically insulative housing having a cord aperture at one end thereof and a post aperture at the other end thereof, a forwardly projecting, electrically conductive post means held in said post aperture for making electrical connection with a contact means that is functionally associated with the central interior end region of said socket, a laterally outwardly extending electrically conductive leg means held by said housing for making electrical connection with an electrically conductive inside surface portion of said socket;

a female type electrical connecting socket having:

an electrically insulative housing that has a first outside wall portion wherein three contiguous socket channels are adjacently defined, two of said socket channels having opposed flattened sides and the third said socket channel having a rounded side portion, said socket channels being adapted in combination to be connectable with any predetermined standard two or three prong male type electrical connector for a predetermined said higher voltage, and that also has a second outside wall portion wherein a second cord aperture is defined, and electrical contact means associated with a wall portion of each of said two sockets;

a relative short length of insulated two-wire electrical cord that extends between said first and said second cord apertures, one of said two wires being interconnected between one of said contact means for one of said two sockets and said post means, the other of said two wires being interconnected between said contact means for the second of said two sockets and said leg means; and fuse means for limiting the maximum amperage of current which can pass between said male plug and said female socket, said fuse means being connected in parallel with one of said two wires; whereby said low voltage current can pass from said cigarette lighter plug through said female socket, but said higher voltage cannot pass from said female socket through said cigarette lighter plug.

2. The adapter of claim 1 wherein said fuse is located in said cigarette lighter plug.

3. The adapter of claim 1 which further includes a pair of battery connector clips, each one of said battery connector clips being independently electrically connected by insulated wire means to a different one of said two wires whereby said low voltage current can also pass from said battery connector clips through said female socket, but said higher voltage cannot pass from said female socket through said battery connector clips.

4. The adapter of claim 3 which further includes electrically insulative storage pouch means for each one of said battery connector clips whereby said pouch means covers exposed, electrically conductive portions of said clips when said clips are not connected to a battery.

5. The adapter of claim 4 wherein said pouch means is unitary and is adapted to hold each one of said clips in electrically insulated relationship relative to the other thereof.

6. The adapter of claim 3 wherein said fuse means is located in a position that is approximately between where said insulated wire means connect with said two wires and where said two wires interconnect with said contact means.

7. The adapter of claim 1 wherein said cord is insulatively sealed to said housing of said female socket.

8. The adapter of claim 1 which further includes diode means for limiting passage of current at said substantially higher voltage from said socket through said adapter.

* * * * *